US006880629B2

(12) United States Patent
Schroeder

(10) Patent No.: US 6,880,629 B2
(45) Date of Patent: Apr. 19, 2005

(54) WELL STRING INJECTION SYSTEM WITH GRIPPER PADS

(75) Inventor: Jason Schroeder, Edmonton (CA)

(73) Assignee: C-Tech Energy Services, Inc. (CA)

( * ) Notice: Subject to any disclaimer, the term of this patent is extended or adjusted under 35 U.S.C. 154(b) by 100 days.

(21) Appl. No.: 10/329,297

(22) Filed: Dec. 23, 2002

(65) Prior Publication Data

US 2004/0118573 A1 Jun. 24, 2004

(51) Int. Cl.[7] ..... E21B 19/10

(52) U.S. Cl. ..... 166/77.3; 226/172; 226/173; 166/380

(58) Field of Search ..... 166/77.2, 77.3, 166/380; 226/172, 173; 254/265

(56) References Cited

U.S. PATENT DOCUMENTS

| | | | | |
|---|---|---|---|---|
| 1,837,990 A | 12/1931 | Otis | ..... | 254/29 R |
| 1,895,132 A | 1/1933 | Minor | ..... | 166/77.4 |
| RE25,680 E | 11/1964 | Brown | ..... | 254/29 R |

(Continued)

FOREIGN PATENT DOCUMENTS

| | | | | |
|---|---|---|---|---|
| CA | 953644 | 8/1974 | ..... | 166/521 |
| CA | 1096850 | 3/1981 | ..... | 255/12 |
| CA | 1178533 | 11/1984 | ..... | 166/52 |
| CA | 1220418 | 4/1987 | ..... | 166/53 |
| CA | 1265998 | 2/1990 | ..... | 166/52 |
| CA | 2217413 | 10/1997 | | |
| CA | 2299765 | 2/2000 | | |

OTHER PUBLICATIONS

Canadian patent application no. 2,351,648 filed Jun. 25, 2001 (corresponds to U.S. Appl. No. 2003/0034162, Kulhanek.

X–celerator information sheet distributed on Jun. 10, 2000 by C–tech Oilwell Technologies, Inc. at the Calgary Oil Show in Calgary, Alberta, Canada.

Sperry Vickers, "Mobile Hydraulics Manual M–2990–A" First Edition 1967; Second Edition 1979.

Industrial Fluid Power, vol. 3, Second Edition Published by Womack Educational Publications.

Robinshaw Engineering Inc. of Houston, Texas Drawing.

Design Engineers Handbook; Bulletin 0224–B1.

*Primary Examiner*—William P Neuder

(74) *Attorney, Agent, or Firm*—Frank J. Dykas; Dykas, Shaver & Nipper

(57) ABSTRACT

A continuous well string injection unit, comprising a pair of motor driven continuous chains mounted opposed to each for gripping coiled rod between them. Plural links are connected end to end in each one of the pair of motor driven continuous chains, in which each link comprises a connected yoke and a neck, the neck of each link being sized to fit within the yoke of a succeeding link in the motor driven continuous chain with consecutive links connected by a pin extending through the neck of one link and the yoke of the next succeeding link. A method of injecting coiled rod into a well is also provided.

12 Claims, 2 Drawing Sheets

CHAIN ASSEMBLY DETAIL

U.S. PATENT DOCUMENTS

| | | | | | |
|---|---|---|---|---|---|
| 3,215,203 | A | | 11/1965 | Sizer | 166/77 |
| 3,285,485 | A | | 11/1966 | Slator | 226/172 |
| 3,313,346 | A | | 4/1967 | Cross | 166/5 |
| 3,373,818 | A | | 3/1968 | Rike et al. | |
| 3,559,905 | A | | 2/1971 | Palynchuk | 242/54 |
| 3,754,474 | A | | 8/1973 | Palynchuk | 74/162 |
| 3,926,260 | A | | 12/1975 | Slator | 166/315 |
| 4,475,607 | A | | 10/1984 | Haney | 175/423 |
| 4,673,035 | A | | 6/1987 | Gipson | 166/77 |
| 4,715,456 | A | | 12/1987 | Poe, Jr. et al. | 175/423 |
| 5,094,340 | A | | 3/1992 | Avakov | 198/626.1 |
| 5,133,405 | A | * | 7/1992 | Elliston | 166/77.3 |
| 5,188,174 | A | | 2/1993 | Anderson, Jr. | 166/77 |
| 5,309,990 | A | | 5/1994 | Lance | 166/77 |
| 5,348,097 | A | | 9/1994 | Giannesini et al. | 166/385 |
| 5,553,668 | A | | 9/1996 | Council et al. | 166/77.3 |
| 5,842,530 | A | | 12/1998 | Smith et al. | |
| 5,853,118 | A | * | 12/1998 | Avakov | 226/173 |
| 5,890,534 | A | | 4/1999 | Burge et al. | 166/77.3 |
| 5,975,203 | A | * | 11/1999 | Payne et al. | 166/77.3 |
| 5,992,516 | A | | 11/1999 | Palynchuk et al. | 166/77.2 |
| 6,173,769 | B1 | * | 1/2001 | Goode | 166/77.3 |
| 6,189,609 | B1 | * | 2/2001 | Shaaban et al. | 166/77.3 |
| 6,230,955 | B1 | * | 5/2001 | Parks | 226/190 |
| 6,332,501 | B1 | | 12/2001 | Gipson | |
| 6,425,441 | B1 | * | 7/2002 | Shaaban et al. | 166/77.3 |
| 6,575,241 | B1 | | 6/2003 | Widney et al. | 166/242.2 |
| 6,609,566 | B1 | * | 8/2003 | Perio, Jr. | 166/77.3 |
| 2001/0040031 | A1 | * | 11/2001 | Shaaban et al. | 166/77.3 |
| 2002/0046833 | A1 | * | 4/2002 | Perio, Jr. | 166/77.3 |
| 2003/0034162 | A1 | | 2/2003 | Kulhanek | 166/384 |
| 2004/0020658 | A1 | * | 2/2004 | Kulhanek et al. | 166/377 |

* cited by examiner

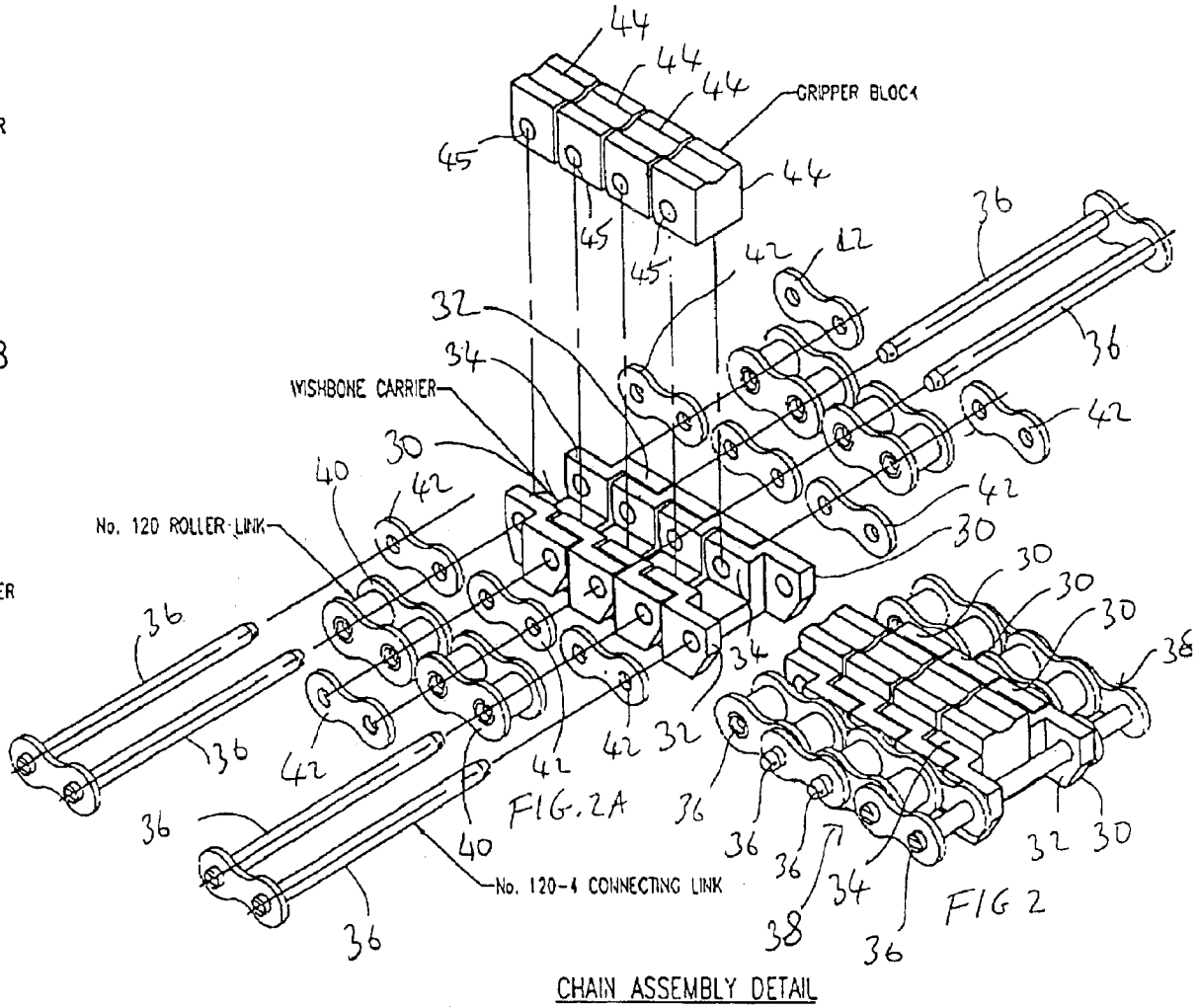
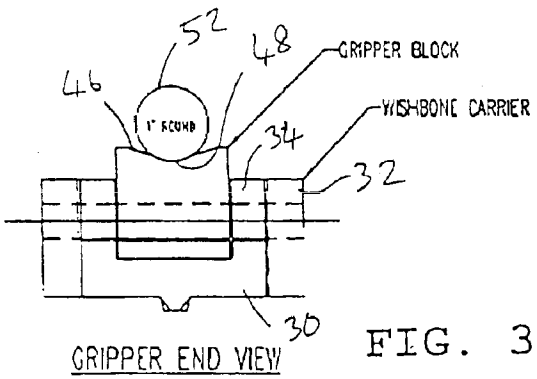
FIG. 3
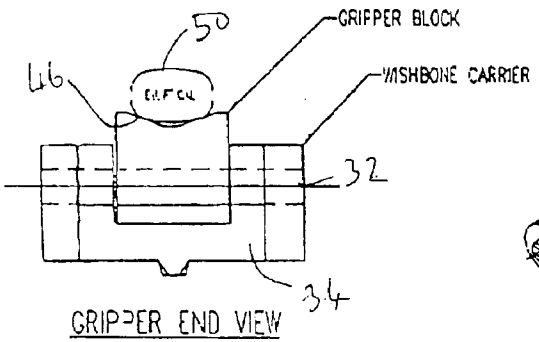
FIG. 4

WELL STRING INJECTION SYSTEM WITH GRIPPER PADS

BACKGROUND OF THE INVENTION

This invention relates to devices used to grip coiled rod for injection into wellbores during wellsite operations. Coiled rod is manipulated downhole typically with continuous feed injection units that include gripper pads for gripping the well strings. One early such design is shown in U.S. Pat. No. 3,559,905 of Palynchuk, issued Feb. 1, 1971, in which a continuous chain with gripping blocks carried by the chain is used to inject the well string into the well. More recently, such continuous chain gripper systems have been described in U.S. Pat. No. 5,553,668 of Council, et al, issued Sep. 10, 1996. As disclosed in Canadian patent application no. 2,351,648 published Feb. 21, 2002 the continuous feed injection units may be suspended from the travelling block of a drilling rig and coiled rod is fed through a guide from a carousel into the continuous feed injection unit.

Gripper pads used previously with coiled rod are of the chain type. These chain type gripper pads have a tendency to wear in a manner called crowning. The individual pads tend to break down at their ends with the result that the gripper pad surfaces take on a convex shape. When the two chains of the continuous feed injection units are out of synchronization, the convex surfaces of one chain fall between the convex surfaces of the opposed chain. Pressure from the pads on each other then tend to bend the coiled rod, rendering it unsuitable for use. One way to avoid gripper pad crowning is to use hardened steel for the gripper pads, but the use of hardened steel tends to scar the rod. Another way to avoid gripper pad crowning is to make the chains run synchronously, but again this is expensive.

SUMMARY OF THE INVENTION

To reduce costs of operating rod injection units, there is provided a continuous well string injection unit, comprising a pair of motor driven continuous chains mounted opposed to each for gripping coiled rod between them. Plural links are connected end to end in each one of the pair of motor driven continuous chains, in which each link comprises a connected yoke and a neck, the neck of each link being sized to fit within the yoke of a succeeding link in the motor driven continuous chain with consecutive links connected by a pin extending through the neck of one link and the yoke of the next succeeding link.

According to another aspect of the invention, there is provided a method of injecting coiled rod into a well, the method comprising the steps of:

driving a pair of continuous chains mounted opposed to each with a coiled rod gripped between between them; and gripping the coiled rod with plural links connected end to end in each one of the pair of motor driven continuous chains, in which each link comprises a connected yoke and a neck, the neck of each link being sized to fit within the yoke of a succeeding link in the motor driven continuous chain with consecutive links connected by a pin extending through the neck of one link and the yoke of the next succeeding link.

According to further aspects of the invention, a rod gripper pad is preferably seated within each link for gripping coiled rod. Each rod gripper pad preferably occupies the neck of a link, and succeeding rod gripper pads are separated by a gap that is less than one tenth of the length of the rod gripper pad. Each rod gripper pad may include a pair of rod gripping profiles, a first of the pair of rod gripping profiles being contoured for gripping elliptical rod and a second of the pair of rod gripping profiles being contoured for gripping round rod.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like reference characters denote like elements and in which:

FIG. 2 is a perspective view of a series of rod gripper pads according to the invention;

FIG. 2A is an exploded view of the rod gripper pads of FIG. 2;

FIG. 3 is an end view of a rod gripper pad according to the invention showing how round rod is gripped; and FIG. 4 is an end view of a rod gripper pad according to the invention showing how elliptical rod is gripped.

DETAILED DESCRIPTION OF PREFERRED EMBODIMENTS

Figure 1:
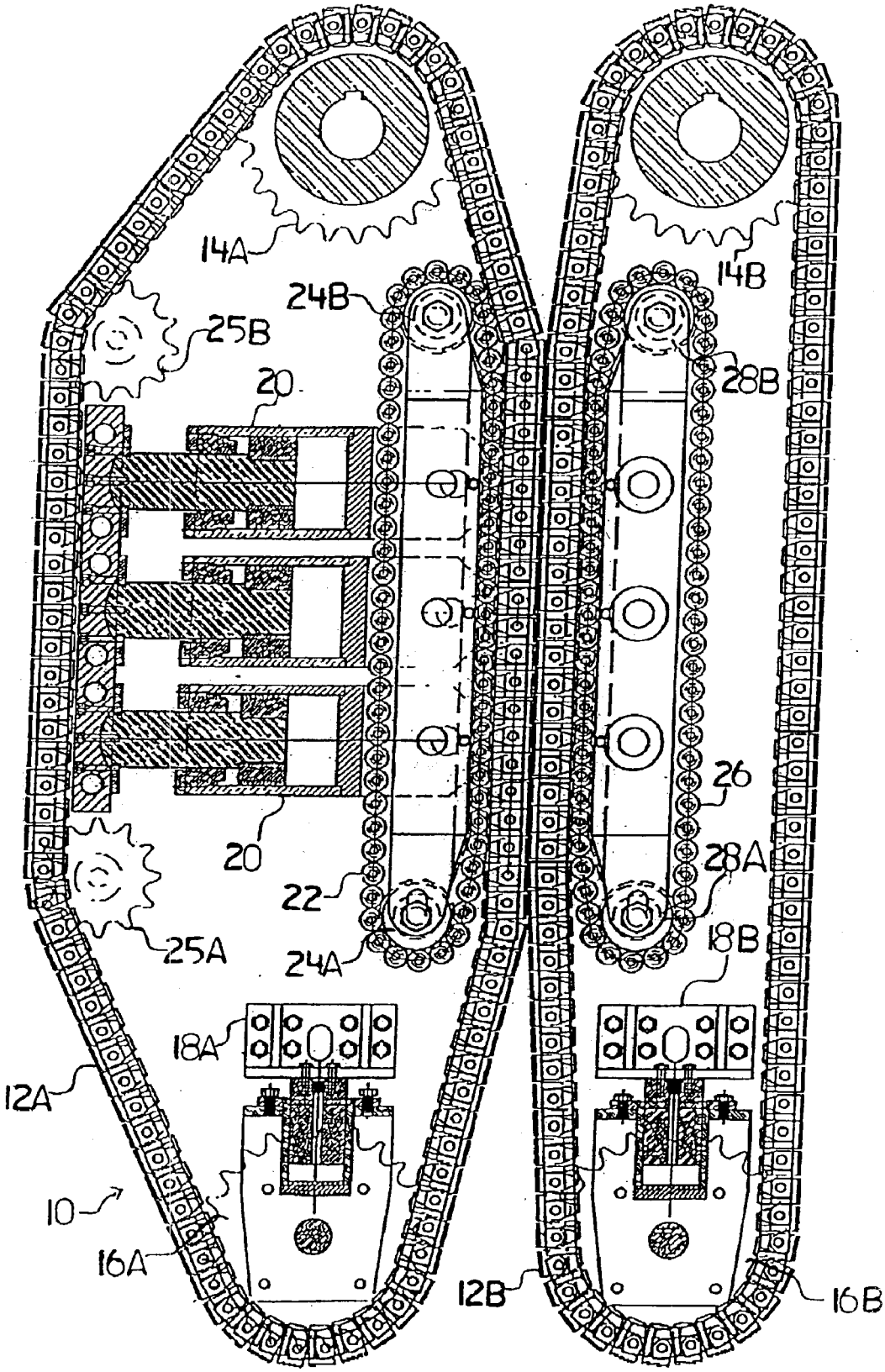
FIG. 1 shows a side view of a continuous feed injection unit having rod gripper pads according to the invention.

In this patent document, "comprising" means "including". In addition, a reference to an element by the indefinite article "a" does not exclude the possibility that more than one of the element is present.

Referring to FIG. 1, there is shown a continuous well string injection unit 10 with a pair of continuous chains 12A, 12B. The drive chain and power supply for the continuous feed injection unit 10 may be conventional or may be a unit such as the X-celerator™ of C-Tech Energy Services Inc. of Edmonton, Alberta, Canada. Continuous chain 12A is driven by sprocket 14A and continuous chain 12B is driven by sprocket 14B. The continuous chains 12A, 12B may be driven using one or two motors connected to the sprockets 14A, 14B. Continuous chains 12A, 12B are also mounted respectively on sprockets 16A, 16B, which are mounted on tensioning devices 18A, 18B. Pressure on rod gripped by the continuous feed injection unit 10 is applied by hydraulic pistons 20, which bear up against chain 22 mounted on wheels 24A, 24B. Sprockets 25A, 25B maintain spacing of the continuous chain 12A away from the hydraulic pistons 20. Opposing the pressure of the chain 22 is a chain 26 mounted on wheels 28A, 28B. Apart from the construction of the chains 12A, 12B to be described in more detail in relation to FIGS. 2 and 2A, the continuous feed injection unit 10 is conventional.

Referring to FIGS. 2 and 2A, plural links 30 are connected end to end in each one of the pair of chains 12A, 12B. Each link 30 comprises a connected yoke 32 and a neck 34. The neck 34 of each link 30 is sized to fit within the yoke 32 of a succeeding link 30 in the chain 12A, 12B with consecutive links 30 connected by a pin 36 extending through the neck 34 of one link 30 and the yoke 32 of the next succeeding link 30. This construction of the links 30 makes the links 30 have a wishbone shape. A pair of roller link chains 38 formed of roller links 40 and connecting links 42 are disposed on either side of the connected links 30 to permit the continuous chains to be driven by the sprockets 14A, 14B. The pins 36 are provided in connected pairs to connect adjacent roller links 40, with succeeding pin pairs being provided on opposed sides of the chains 12A, 12B.

Referring to FIGS. 3 and 4 in particular, a rod gripper pad 44 is seated within each link 30 for gripping coiled rod and each pad 44 is provided with a bore 45 for receiving a pin 36. Each rod gripper pad 44 includes a pair of rod gripping profiles 46, 48. A first 46 of the pair of rod gripping profiles 46, 48 is contoured for gripping elliptical rod 50 and a second 48 of the pair of rod gripping profiles 46, 48 is contoured for gripping round rod 52. Each rod gripper pad 44 occupies the neck 34 of a link 30. That is, the gripper pad 44 extends the full length of the neck 34. Preferably, the gap between rod gripper pads 44 is a small fraction of the length of each rod gripper pad 44, for example less than one tenth of the length of the rod gripper pad 44.

In operation, the continuous chains are driven with a coiled rod gripped between between them. Coiled rod 50 or 52 is gripped with the plural links 30 connected end to end in each one of the pair of continuous chains 12A, 12B. The close proximity of the gripper pads 44, which is made possible by the use of the links 30, prevents crowning of the rod gripper pads 44 even when the chains 12A, 12B are not synchronized. While gripper pads have been used for many years with coiled tubing, they have not been used for injection of rod into wells. The gripper blocks 44 are preferably made of 7075 heat treated aluminum of the type commonly used in aircraft construction.

Immaterial modifications may be made to the invention described here without departing from the invention.

What is claimed is:

1. A continuous well string injection unit comprising:

a pair of motor driven continuous chains mounted opposed to each for gripping coiled rod between them;

plural links connected end to end in each one of the pair of motor driven continuous chains, in which each link comprises a connected yoke and a neck, the neck of each link being sized to fit within the yoke of a succeeding link in the motor driven continuous chain with consecutive links connected by a pin extending through the neck of one link and the yoke of the next succeeding link; and a rod gripper pad seated within each link of a gripping coiled rod.

2. The continuous well string injection unit of claim 1 in which each rod gripper pad occupies the neck of a link.

3. The continuous well string injection unit of claim 2 in which succeeding rod gripper pads are separated by a gap that is less than one tenth the length of the rod gripper pad.

4. The continuous well string injection unit of claim 2 in which each rod gripper pad includes a pair of rod gripping profiles, a first of the pair of rod gripping profiles being contoured for gripping elliptical rod and a second of the pair of rod gripping profiles being contoured for gripping round rod.

5. The continuous well string injection unit of claim 4 wherein the first pair of said rod gripping profiles is curved.

6. The continuous well string injection unit of claim 1 wherein said rod gripper pads are made of aluminum.

7. A method of injecting coiled rod into a well, the method comprising the steps of:

driving a pair of continuous chains mounted opposed to each with a coiled rod gripped between them;

gripping the coiled rod with plural links connected end to end in each one of the pair of motor driven continuous chains, in which each link comprises a connected yoke and a neck, the neck of each link being sized to fit within the yoke of succeeding link in the motor driven continuous chain with consecutive links connected by a pin extending through the neck of one link and the yoke of the next succeeding link; and gripping the coiled rod by rod gripper pads seated within each link.

8. The method of claim 5 in which each rod gripper pad occupies the neck of a link.

9. The method of claim 8 in which succeeding rod gripper pads are separated by a gap that is less than one tenth the length of the rod gripper pad.

10. The method of claim 9 in which gripping the coiled rod comprises gripping the coiled rod with a rod gripper pad having a pair of rod gripper profiles, a first of the pair of rod gripping profiles being contoured for gripping elliptical rod and a second of the pair of rod gripping profiles being contoured for gripping round rod.

11. The method of claim 10 wherein the first pair of said rod gripping profiles is curved.

12. The method of claim 7 wherein said rod gripper pads are made of aluminum.

* * * * *